US010942471B2

(12) United States Patent
Ogawa et al.

(10) Patent No.: US 10,942,471 B2
(45) Date of Patent: Mar. 9, 2021

(54) ELECTROPHOTOGRAPHIC MEMBER HAVING A SURFACE LAYER WITH A CROSS-LINKED URETHANE RESIN-CONTAINING MATRIX, PROCESS CARTRIDGE, AND APPARATUS

(71) Applicant: CANON KABUSHIKI KAISHA, Tokyo (JP)

(72) Inventors: Yoshinobu Ogawa, Numazu (JP); Ryo Sugiyama, Mishima (JP); Kazuaki Nagaoka, Susono (JP); Kenta Matsunaga, Susono (JP); Toru Ishii, Mishima (JP); Hideya Arimura, Shizuoka (JP); Fumihiko Utsuno, Suntou-gun (JP); Tomoya Uesugi, Susono (JP); Wataru Moriai, Suntou-gun (JP); Masashi Uno, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/821,131

(22) Filed: Mar. 17, 2020

(65) Prior Publication Data

US 2020/0310283 A1 Oct. 1, 2020

(30) Foreign Application Priority Data

Mar. 29, 2019 (JP) ..... JP2019-069102
Oct. 11, 2019 (JP) ..... JP2019-187337

(51) Int. Cl.
*G03G 15/08* (2006.01)
*G03G 21/18* (2006.01)

(52) U.S. Cl.
CPC ..... *G03G 15/0818* (2013.01); *G03G 21/1814* (2013.01)

(58) Field of Classification Search
USPC ..... 399/286, 159
See application file for complete search history.

(56) References Cited

U.S. PATENT DOCUMENTS 4,871,649 A 10/1989 Imataki et al.
7,727,134 B2 6/2010 Nakamura et al.
(Continued)

FOREIGN PATENT DOCUMENTS

JP 2003-202014 7/2003
JP 2006-350097 12/2006
(Continued)

OTHER PUBLICATIONS

European Search Report dated Aug. 5, 2020 in counterpart application EP 20164870.6. (9 pages).

*Primary Examiner* — Quana Grainger
(74) *Attorney, Agent, or Firm* — Venable LLP

(57) ABSTRACT

The electrophotographic member includes: an electroconductive substrate; and a surface layer having a mono-layer structure, wherein the surface layer has a matrix containing a cross-linked urethane resin as a binder, and when an elastic modulus of the matrix in a first region in a thickness direction from an outer surface of the surface layer to a depth of 0.1 μm from the outer surface of the surface layer is defined as E1, and an elastic modulus of the matrix in a second region in a thickness direction from a depth of 1.0 μm from the outer surface of the surface layer to 1.1 μm from the outer surface of the surface layer is defined as E2, E1 and E2 satisfy the following Expressions (1) and (2), respectively:

$$E1 \geq 200 \text{ MPa} \quad (1); \text{ and}$$

$$10 \text{ MPa} \leq E2 \leq 100 \text{ MPa} \quad (2).$$

12 Claims, 4 Drawing Sheets

(56) References Cited

U.S. PATENT DOCUMENTS

| | | | | |
|---|---|---|---|---|
| 7,797,833 | B2 | 9/2010 | Nakamura et al. | |
| 8,176,632 | B2 | 5/2012 | Kawamura et al. | |
| 8,600,273 | B2 | 12/2013 | Yamada et al. | |
| 8,655,238 | B2 | 2/2014 | Uno et al. | |
| 8,706,011 | B2 | 4/2014 | Anan et al. | |
| 8,745,870 | B2 | 6/2014 | Kawamura et al. | |
| 8,837,985 | B2 | 9/2014 | Ishida et al. | |
| 8,846,287 | B2 | 9/2014 | Yamada et al. | |
| 8,913,930 | B2 | 12/2014 | Ishii et al. | |
| 9,017,239 | B2 | 4/2015 | Ishida et al. | |
| 9,372,429 | B2 | 6/2016 | Watanabe et al. | |
| 9,436,151 | B2 | 9/2016 | Hayashi et al. | |
| 9,599,913 | B2 | 3/2017 | Nishioka et al. | |
| 9,625,854 | B2 | 4/2017 | Koyanagi et al. | |
| 9,639,009 | B2 | 5/2017 | Yamaguchi et al. | |
| 9,665,028 | B2 | 5/2017 | Arimura et al. | |
| 9,804,428 | B2 * | 10/2017 | Chung | G02F 1/133305 |
| 9,811,009 | B2 | 11/2017 | Yamada et al. | |
| 9,846,407 | B2 | 12/2017 | Nakamura et al. | |
| 9,921,518 | B2 | 3/2018 | Sakurai et al. | |
| 9,952,531 | B2 | 4/2018 | Ishii et al. | |
| 9,952,532 | B2 | 4/2018 | Sugiyama et al. | |
| 9,964,914 | B2 | 5/2018 | Arimura et al. | |
| 9,977,359 | B2 | 5/2018 | Koyanagi et al. | |
| 10,018,934 | B2 | 7/2018 | Yamada et al. | |
| 10,031,438 | B2 | 7/2018 | Wakabayashi et al. | |
| 10,108,129 | B2 | 10/2018 | Yamaguchi et al. | |
| 10,303,079 | B2 | 5/2019 | Utsuno et al. | |
| 10,310,447 | B2 | 6/2019 | Morishita et al. | |
| 10,331,054 | B2 | 6/2019 | Urushihara et al. | |
| 10,379,460 | B2 | 8/2019 | Arimura et al. | |
| 10,539,891 | B1 | 1/2020 | Ishii et al. | |
| 10,571,825 | B1 | 2/2020 | Urushihara et al. | |
| 2007/0212128 | A1 * | 9/2007 | Asakura | G03G 15/169 399/307 |
| 2009/0245892 | A1 | 10/2009 | Obara et al. | |
| 2011/0091240 | A1 | 4/2011 | Anan et al. | |
| 2013/0028634 | A1 * | 1/2013 | Koyanagi | G03G 15/0818 399/111 |
| 2013/0130022 | A1 | 5/2013 | Uesugi et al. | |
| 2013/0164038 | A1 | 6/2013 | Kusaba et al. | |
| 2013/0266339 | A1 | 10/2013 | Sugiyama et al. | |
| 2013/0310239 | A1 * | 11/2013 | Terada | G03G 15/02 492/18 |
| 2015/0331346 | A1 | 11/2015 | Yamauchi et al. | |
| 2016/0363881 | A1 | 12/2016 | Urushihara et al. | |
| 2017/0139336 | A1 | 5/2017 | Nagaoka et al. | |
| 2018/0217551 | A1 | 8/2018 | Arimura et al. | |
| 2019/0094741 | A1 | 3/2019 | Uno et al. | |
| 2019/0265609 | A1 | 8/2019 | Sakurai et al. | |
| 2019/0302644 | A1 | 10/2019 | Yamada et al. | |
| 2019/0310394 | A1 * | 10/2019 | Miyamoto | C23C 14/10 |
| 2019/0324382 | A1 | 10/2019 | Sugiyama et al. | |
| 2019/0324383 | A1 | 10/2019 | Arimura et al. | |
| 2020/0012210 | A1 * | 1/2020 | Imai | G03G 15/0818 |
| 2020/0033742 | A1 | 1/2020 | Komatsu et al. | |
| 2020/0041920 | A1 | 2/2020 | Arimura et al. | |
| 2020/0041921 | A1 | 2/2020 | Yamaguchi et al. | |
| 2020/0041926 | A1 | 2/2020 | Ishida et al. | |
| 2020/0041928 | A1 | 2/2020 | Tsuru et al. | |
| 2020/0073278 | A1 | 3/2020 | Doi et al. | |
| 2020/0073279 | A1 | 3/2020 | Wakabayashi et al. | |
| 2020/0073309 | A1 | 3/2020 | Matsunaga et al. | |
| 2020/0096898 | A1 | 3/2020 | Utsuno et al. | |
| 2020/0166866 | A1 | 5/2020 | Moriai et al. | |
| 2020/0174397 | A1 | 6/2020 | Ishida et al. | |

FOREIGN PATENT DOCUMENTS

| | | |
|---|---|---|
| JP | 2008-165214 A | 7/2008 |
| JP | 2012-215647 A | 11/2012 |
| JP | 2014-197064 | 10/2014 |
| JP | 2015-187721 | 10/2015 |
| JP | 2017-049282 | 3/2017 |

* cited by examiner

ELECTROPHOTOGRAPHIC MEMBER HAVING A SURFACE LAYER WITH A CROSS-LINKED URETHANE RESIN-CONTAINING MATRIX, PROCESS CARTRIDGE, AND APPARATUS

BACKGROUND OF THE INVENTION

Field of the Invention

The present disclosure relates to an electrophotographic member incorporated in an apparatus adopting an electrophotographic system. In addition, the present disclosure relates to a process cartridge and an electrophotographic image forming apparatus that include the electrophotographic member.

Description of the Related Art

In an electrophotographic image forming apparatus (also referred to as "electrophotographic apparatus") according to an aspect, an image carrier is charged by a charging unit, and an electrostatic latent image is formed by a laser. Next, a toner in a developing container is applied onto a developing member by a toner-supplying roller and a toner regulating member to develop the electrostatic latent image with the toner by bringing the image carrier into contact with or close to the developing member. Subsequently, the toner on the image carrier is transferred onto a recording paper by a transfer unit, and fixed by heat and a pressure, and the toner remaining on the image carrier is removed by a cleaning blade.

Such an electrophotographic apparatus is required to have a higher image quality and durability, and a faster printing speed than ever before. Therefore, the electrophotographic member is also required to have a higher performance.

For example, in a case where a durable life of the electrophotographic apparatus is extremely extended, a surface of an electrophotographic member according to the related art is scraped by repeated rubbing and scratches may thus be generated thereon. Moreover, a significant filming may occur due to the adhesion or deposition of developer components. It may be difficult to form a high quality electrophotographic image by using such an electrophotographic member. In order to stably and continuously output the high quality electrophotographic image for a longer period of time, there is a demand for an electrophotographic member in which the generation of scratches due to scraping of the surface layer or the occurrence of filming are suppressed at a high level, that is, an electrophotographic member having an excellent durability.

Japanese Patent Application Laid-Open No. 2014-197064 discloses a modified rubber elastic body including a rubber elastic body with rubber elasticity, and a surface-treated layer composed of a cured product of a photocurable composition impregnated into the rubber elastic body from a surface thereof, and an electrophotographic member using the same. The photocurable composition includes a (meth) acrylic monomer; a photopolymerizable polymer having a silicon-containing group and/or a fluorine-containing group, and a (meth)acryloyl group in a molecule; and a photopolymerization initiator. In addition, it is disclosed that, according to the electrophotographic member, both toner releasability and low friction property are achieved.

SUMMARY OF THE INVENTION

An aspect of the present disclosure is directed to providing an electrophotographic member capable of implementing the formation of a high quality electrophotographic image for a long period of time.

Another aspect of the present disclosure is directed to providing a process cartridge that contributes to the stable formation of a high quality electrophotographic image.

Still another aspect of the present disclosure is directed to providing an electrophotographic image forming apparatus capable of stably forming a high quality electrophotographic image.

According to an aspect of the present disclosure, there is provided an electrophotographic member including: an electroconductive substrate; and a surface layer having a monolayer structure on the substrate, wherein the surface layer has a matrix containing a cross-linked urethane resin as a binder, and when an elastic modulus of the matrix in a first region in a thickness direction from an outer surface of the surface layer to a depth of 0.1 μm from the outer surface of the surface layer is defined as E1, and an elastic modulus of the matrix in a second region in a thickness direction from a depth of 1.0 μm from the outer surface of the surface layer to 1.1 μm from the outer surface of the surface layer is defined as E2, E1 and E2 being measured in a cross section of the surface layer in a thickness direction, E1 and E2 satisfy the following Expressions (1) and (2), respectively:

$$E1 \geq 200 \text{ MPa} \quad (1); \text{ and}$$

$$10 \text{ MPa} \leq E2 \leq 100 \text{ MPa} \quad (2).$$

According to another aspect of the present disclosure, there is provided a process cartridge detachably attachable to a main body of an electrophotographic image forming apparatus, comprising the electrophotographic member.

According to still another aspect of the present disclosure, there is provided an electrophotographic image forming apparatus including: an image carrier carrying an electrostatic latent image; a charging device primarily charging the image carrier; an exposing device forming an electrostatic latent image on the primarily charged image carrier; a developing member developing the electrostatic latent image by a toner and forming a toner image; and a transfer device transferring the toner image onto a transfer material, wherein the developing member is the above mentioned electrophotographic member.

Further features of the present disclosure will become apparent from the following description of exemplary embodiments with reference to the attached drawings.

DESCRIPTION OF THE EMBODIMENTS

Figure 1A:
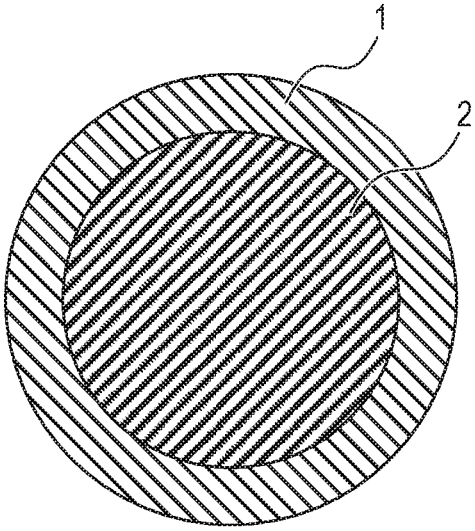
FIGS. 1A and 1B are schematic views illustrating an electrophotographic member according to an embodiment of the present disclosure.

As disclosed in Japanese Patent Application Laid-Open No. 2014-197064, in a case where an electrophotographic member formed of a rubber composition treated with a treatment solution containing a polymer is provided for forming a plurality of electrophotographic images in a high temperature environment, filming or scratches may occur on a surface of the electrophotographic member. It is considered that the reason why the filming easily occurs is that, since an acrylic polymer with a high hardness is present in the vicinity of the surface of the electrophotographic member at a depth of about several μm, a large load is applied to the toner, and the deteriorated toner is thus fixed onto the surface of the electrophotographic member. In addition, it is considered that the reason why the scratches are generated is that a toughness of the acrylic polymer present on the surface of the electrophotographic member is low, and cracks are thus easily generated due to rubbing with other members.

Therefore, as a result of repeated studies, attention was paid to an elastic modulus of a surface layer of the electrophotographic member in a depth direction. That is, it was found that, by optimizing the elastic modulus, the generation of the scratches due to scraping of the surface of the electrophotographic member can be suppressed without severe filming even in a long-term use while printing a number of sheets in a high temperature environment.

An electrophotographic member according to an embodiment of the present disclosure includes an electroconductive substrate; and a surface layer having a mono-layer structure on the substrate. The surface layer has a matrix containing a cross-linked urethane resin as a binder. When an elastic modulus of the matrix in a first region in a thickness direction from an outer surface of the surface layer to a depth of 0.1 μm from the outer surface of the surface layer is defined as E1, and an elastic modulus of the matrix in a second region in a thickness direction from a depth of 1.0 μm from the outer surface of the surface layer to 1.1 μm from the outer surface of the surface layer is defined as E2, E1 and E2 being measured in a cross section of the surface layer in a thickness direction, E1 and E2 satisfy the following Expressions (1) and (2), respectively:

$$E1 \geq 200 \text{ MPa} \quad (1); \text{ and}$$

$$10 \text{ MPa} \leq E2 \leq 100 \text{ MPa} \quad (2).$$

The reason why the scratches due to scraping of the surface layer and the filming due to the deterioration of the toner in the high temperature environment can be suppressed in the electrophotographic member is observed as follows.

Urethane bonds are cross-linked by reacting a polyol hydroxyl group and an isocyanate compound with each other, thereby obtaining a cross-linked urethane resin. The cross-linking here means that the obtained urethane resin has a three-dimensional network structure rather than a straight chain structure, because any one or both of a polyol or isocyanate compound has three or more reactive functional groups.

In addition, in the present embodiment, the elastic modulus E1 of the first region in the vicinity of the outer surface is set to be high, and the elastic modulus E2 of the second region having a predetermined depth is set to be low.

Therefore, in order to increase the elastic modulus of a surface side of the cross-linked urethane resin constituting the matrix of the surface layer, for example, an interpenetrating polymer network structure is formed.

First, the interpenetrating polymer network structure will be described. The interpenetrating polymer network structure (hereinafter, referred to as an IPN structure) is a structure in which two or more polymer networks are not bonded by a covalent bond, but are assembled and tangled with each other. In addition, this structure is not unraveled unless a polymer chain forming the network is cut.

As a method of forming an IPN structure, various methods can be exemplified. An example of the method of forming an IPN structure may include a sequential network forming method in which a first component polymer network is first formed, and then a second component polymer network is formed after the first component polymer network is swollen with a second component monomer and a polymerization initiator. Alternatively, an example of the method of forming an IPN structure may include a simultaneous network forming method in which a first component monomer and a second component monomer that have different reaction mechanisms, and respective polymerization initiators are mixed to simultaneously form a network.

In the present embodiment, it is preferable that the IPN structure is formed by using a cross-linked polymer, in particular, a cross-linked acrylic resin, that has a higher elastic modulus than that of the cross-linked urethane resin. The IPN structure is formed by impregnating a cross-linked urethane resin, that is, a first component, with acrylic monomers and a polymerization initiator from the outer surface, and then forming a cross-linked acrylic resin as a second component polymer. In this case, the acrylic monomers are penetrated into the three-dimensional network structure of the cross-linked urethane resin and polymerized, thereby forming a network structure of the cross-linked acrylic resin.

In the present embodiment, the IPN structure constituted by the cross-linked urethane resin and the cross-linked acrylic resin is formed, the IPN structure having a thickness of about 1 μm in a depth direction from a surface of the cross-linked urethane resin. In the high temperature environment, an increase in strength by an IPN structure introduction generates a confliction between the scratches due to scraping of the surface layer and the filming due to the toner deterioration. That is, in a case where the IPN structure is formed at a large thickness in a depth direction from the outer surface, the scratches due to scraping of the surface layer can be suppressed, but the load to the toner is increased, and the filming is thus deteriorated.

On the other hand, in a case where the IPN structure is formed at a small thickness in the depth direction from the outer surface, the load to the toner can be reduced and the filming can be suppressed, but the amount of cross-linked acrylic resin should be reduced, and thus the strength of the outer surface is not sufficiently secured, thereby deteriorating the scratches due to scraping of the surface layer. An example of a method of increasing a strength can include a method of significantly increasing a cross-linking density of rubber constituting the surface of the electrophotographic member, but in the case of this method, a hardness is increased according to the increase in strength. Therefore, the load to the toner is increased, and the filming is thus deteriorated. In addition, when the strength is increased by this method, bendability may be reduced and embrittlement may occur, and on the contrary, the scratches due to scraping of the surface layer are deteriorated.

In the configuration of the present embodiment, the strength by the IPN structure constituted by the cross-linked acrylic resin is locally increased in the vicinity of the extreme outer surface of the surface layer, such that a strength and flexibility are exhibited. Therefore, there is no need to unnecessarily increase the cross-linking density, and the bendability and flexibility are not lost. Accordingly, in the configuration of the present embodiment, regardless of the high strength, the load to the toner is suppressed, and the filming is not deteriorated. That is, the generation of the scratches due to scraping of the surface layer and the occurrence of the filming can be extremely suppressed at a high level.

In addition, in order to improve charge stability, durability of developing performance, flowability, and durability of a toner, in general, a toner is preferably obtained by adding, as an additive, a metal oxide such as an alumina fine particle, a titania fine particle, or a silica fine particle to a toner particle. However, a Young's modulus of the additive is generally about 50 GPa ($50\times10^9$ Pa) to 500 GPa ($500\times10^9$ Pa), and when the additive is repeatedly rubbed with the outer surface of the rubber or resin constituting the surface of the electrophotographic member, the scratches due to scraping of the outer surface are deteriorated.

On the other hand, in the present embodiment, the elastic modulus E1 of the first region is 200 MPa ($200\times10^6$ Pa) or more, and the generation of the scratches due to scraping of the surface layer and the occurrence of the filming can be extremely suppressed at a high level.

In addition, a main component of the toner is generally a resin material such as an ester-based resin or a styrene acrylic resin, and a storage elastic modulus at 30° C. in viscoelasticity measurements of the toner is 10 MPa ($10\times10^6$ Pa) or more and 10 GPa ($10\times10^9$ Pa) or less. However, when the toner is repeatedly rubbed with the outer surface of the rubber or resin constituting the surface of the electrophotographic member, the toner is collapsed or deformed, and the filming is thus deteriorated.

On the other hand, in the configuration of the present embodiment, the strength is high in the vicinity of the outer surface of the surface layer, and the flexibility of the inside of the surface layer is sufficiently maintained, the generation of the scratches due to scraping of the surface layer and the occurrence of the filming can be extremely suppressed at a high level. In a case where the elastic modulus of the second region from a depth of 1.0 μm from the outer surface of the surface layer to 1.1 μm from the outer surface of the surface layer is E2, E2 is 10 MPa ($10\times10^6$ Pa) or more and 100 MPa ($100\times10^6$ Pa) or less, and preferably 20 MPa or more and 50 MPa or less.

It should be noted that an upper limit of the elastic modulus E1 of the first region is not particularly limited, but a relationship between the elastic modulus E1 of the first region and the elastic modulus E2 of the second region or an elastic modulus E3 of a third region in a thickness direction of the surface layer to be described later is set in an adequate range. In general, the elastic modulus E1 of the first region is preferably 4,500 MPa ($4{,}500\times10^6$ Pa) or less.

In addition, the surface layer can contain a surfactant such as a modified silicone compound or a modified fluorine compound in addition to the cross-linked urethane resin. The surfactant can have both a low polar group such as a silicon-containing group or a fluorine-containing group, and a high polar group at a modification site.

Since a polarity difference between the urethane group or another high polar group of the cross-linked urethane resin, and the low polar group such as the silicon-containing group or the fluorine-containing group in a molecule of the surfactant is large, the surfactant migrates and stays in the vicinity of the outer surface of the surface layer. Further, in a case where the acrylic monomer and the polymerization initiator are swollen from the outer surface with respect to the cross-linked urethane resin containing the surfactant, when the acrylic monomer having a small polarity difference from the high polar group in the molecule of the surfactant is used, the acrylic monomer stays in the vicinity of the surfactant. That is, the acrylic monomer stays in the vicinity of the outer surface and is cured, such that the IPN structure can be locally formed in the vicinity of the outer surface of the surface layer.

An example of the modified silicone compound may include a polyether-modified silicone oil commercially available, such as "TSF-4445" (product name, manufactured by Momentive Performance Materials Japan LLC).

In addition, an example of the surfactant having a fluorine-containing group may include a fluorine-containing group-containing oligomer commercially available, such as "MEGAFUC F430" (product name, manufactured by DIC Corporation).

Hereinafter, the electrophotographic member having a roller shape (hereinafter, also referred to as "electrophotographic roller") that can be preferably obtained as a developing member, according to an embodiment of the present disclosure will be described, but the shape of the electrophotographic member is not limited thereto.

Figure 1B:
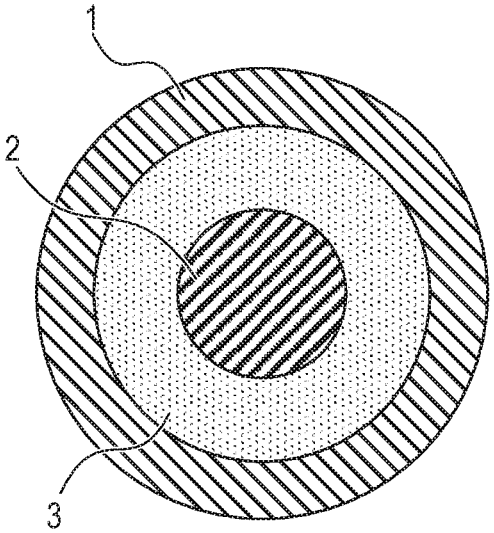

FIG. 1A is a circumferential cross-sectional view of an electrophotographic roller including an electroconductive mandrel 2 as an electroconductive substrate, and a surface layer 1 formed on a circumferential surface of the substrate. FIG. 1B is a circumferential cross-sectional view of a roller-shaped electrophotographic member including a mandrel 2 as an electroconductive substrate, and an intermediate layer 3 between a surface layer 1 and the mandrel 2. The intermediate layer 3 is not limited to a single layer, and may be a plurality of layers. For example, in a non-magnetic one component contact development process, a developing member including the surface layer 1 formed on the electroconductive substrate (the mandrel 2) on which the intermediate layer 3 is stacked is preferably used.

[Electroconductive Substrate]

As the electroconductive substrate, a cylindrical or hollow cylindrical electroconductive mandrel, or a cylindrical or hollow cylindrical electroconductive mandrel on which an intermediate layer having a single layer or a plurality of layers is further provided can be used. A shape of the mandrel is cylindrical or hollow cylindrical, and the mandrel is formed of the following electroconductive material. The mandrel can be formed of a metal or an alloy such as aluminum, a copper alloy, and stainless steel; iron plated with chromium or nickel; or an electroconductive synthetic resin. A known adhesive can also be applied on a surface of the mandrel 2 in order to improve adhesiveness of the intermediate layer 3 or the surface layer 1 that is formed on the outer circumference thereof.

As described above, in the non-magnetic one component contact development process, the developing member in which the intermediate layer 3 is stacked between the mandrel 2 and the surface layer 1 is preferably used. The intermediate layer applies the hardness and elasticity to the developing member to be pressed against the image carrier with an appropriate nip width and nip pressure so that an appropriate amount of toner can be fed to the electrostatic latent image formed on the surface of the image carrier.

The intermediate layer is preferably made of a molded article formed of a general rubber material. Examples of the rubber material may include the following materials: ethylene-propylene-diene copolymer rubber (EPDM), acrylic nitrile-butadiene rubber (NBR), chloroprene rubber (CR), natural rubber (NR), isoprene rubber (IR), styrene-butadiene rubber (SBR), fluororubber, silicone rubber, epichlorohydrin rubber, hydrides of NBR, and urethane rubber. These rubber materials can be used alone or in a combination of two or more thereof. Among them, in particular, silicone rubber is preferable because silicone rubber is unlikely to generate compression set even in a case where the developing member is brought into contact with other members (such as a toner regulating member) for a long period of time. A specific example of the silicone rubber may include a cured product formed of addition-curable silicone rubber.

As the intermediate layer, it is possible to use an intermediate layer formed of the rubber material containing an electroconductivity imparting agent such as an electronic electroconductive substance or an ionic electroconductive substance. A volume resistivity of the intermediate layer is adjusted to preferably $10^3$ Ωcm or more and $10^{11}$ Ωcm or less, and more preferably $10^4$ Ωcm or more and $10^{10}$ Ωcm or less.

Examples of the electronic electroconductive substance may include the following substances: carbon black such as electroconductive carbon, carbon for rubber, or carbon for color (ink), for example, electroconductive carbon black such as Ketjenblack EC or acetylene black; carbon for rubber such as SAF, ISAF, HAF, FEF, GPF, SRF, FT, or MT; carbon for color (ink) subjected to an oxidation treatment; and a metal such as copper, silver, or germanium, and metal oxides thereof. Among them, electroconductive carbon [electroconductive carbon, carbon for rubber, or carbon for color (ink)] is preferable because electroconductivity is easily controlled with a small amount thereof.

Examples of the ionic electroconductive substance may include the following substances: an inorganic ion electroconductive substance such as sodium perchlorate, lithium perchlorate, calcium perchlorate, or lithium chloride; and an organic ion electroconductive substance such as modified aliphatic dimethylammonium ethosulfate or stearylammonium acetate.

These electroconductivity imparting agents are used in an amount needed to adjust the intermediate layer to have an appropriate volume resistivity. In general, the electroconductivity imparting agent is used in a range of 0.5 parts by mass or more and 50 parts by mass or less with respect to 100 parts by mass of a binder resin.

In addition, the intermediate layer can further contain various additives such as a plasticizer, a filler, an extender, a vulcanizing agent, a vulcanizing aid, a cross-linking aid, a curing suppresser, an antioxidant, an anti-aging agent, and a processing aid, if necessary. Examples of the filler may include silica, quartz powder, and calcium carbonate. These optional components are contained in a range in which the function of the intermediate layer is not impaired.

The intermediate layer has elasticity required for the developing member. The elasticity of the intermediate layer preferably has an Asker C hardness of 20 degrees or more and 100 degrees or less. A thickness of the intermediate layer is preferably 0.3 mm or more and 6.0 mm or less.

The respective materials for the intermediate layer can be mixed using a dynamic mixing apparatus such as a monoaxial continuous kneader, a biaxial continuous kneader, a two-roll, a kneader mixer, or a trimix, or a static mixing apparatus such as a static mixer.

A method of forming an intermediate layer on a mandrel is not particularly limited, and examples of the method can include a mold molding method, an extrusion molding method, an injection molding method, and a coating molding method. An example of the mold molding method can include a method of fixing pieces for holding a mandrel in a cylindrical mold to both ends of the cylindrical mold, forming injection ports in the pieces, then disposing the mandrel in the mold, injecting materials for an intermediate layer into the mold through the injection ports, and subsequently heating the mold at a temperature at which the materials are cured to demold the mold. An example of the extrusion molding method can include a method of co-extruding a mandrel and materials for an intermediate layer with a crosshead extruder, curing the materials to form an intermediate layer around the mandrel.

A surface of the intermediate layer can be modified by surface polishing or a surface modification method such as a corona treatment, a frame treatment, or an excimer treatment, in order to enhance adhesion to the surface layer.

[Surface Layer]

The surface layer is a single layer provided on the outermost surface of the electrophotographic member, and in the case of a roller-shaped member, the surface layer is provided on the outermost circumferential surface. The surface layer can be directly formed on a mandrel, but the surface layer can be formed on an outer circumferential surface of a substrate including an intermediate layer formed on a mandrel. The surface layer contains a binder resin. In addition, in a case where the IPN structure in which a cross-linked urethane resin is contained as a binder resin is formed, an IPN structure in which a cross-linked acrylic resin is interpenetrated into the cross-linked urethane resin is preferable.

In addition, resin particles may be added to the surface layer in order to form protrusions on the surface of the electrophotographic member. In a case where a surface roughness is applied to the surface layer, fine particles for imparting a roughness to the surface layer can be contained. Specifically, the fine particles formed of a polyurethane resin, a polyester resin, a polyether resin, a polyamide resin, an acrylic resin, or a polycarbonate resin can be used. These fine particles are preferably cross-linked resin particles. In a case where the IPN structure is formed on the outer surface of the surface layer, the IPN structure may also be formed inside the cross-linked resin particles. A volume average particle diameter of the fine particles is preferably 1.0 μm or more and 30 μm or less, and a surface roughness (ten-point average roughness) Rzjis formed by the fine particles is preferably 0.1 μm or more and 20 μm or less. It should be noted that Rzjis is a value measured based on JIS B0601 (1994).

[Method of Forming Surface Layer]

Hereinafter, in an embodiment of the surface layer in which the IPN structure is constituted by the cross-linked acrylic resin, a method of forming the surface layer will be described.

The surface layer of the present embodiment can be formed by the following steps of:

forming, on an electroconductive substrate, a resin layer containing a cross-linked urethane resin as a binder resin;

impregnating a liquid acrylic monomer on an outer surface of the resin layer; and curing the impregnated acrylic monomer.

The forming of the resin layer containing the cross-linked urethane resin is not particularly limited, but a method of coating a liquid coating material is preferable. For example, the resin layer can be formed by dispersing and mixing respective materials for a resin layer in a solvent to prepare a coating material, applying the coating material onto an electroconductive substrate, and solidifying or heat-curing the applied coating material. As the solvent, a polar solvent is preferable from the viewpoint of the compatibility with a polyol or isocyanate compound that is a raw material of the cross-linked urethane resin.

Examples of the polar solvent may include alcohols such as methanol, ethanol, and n-propanol, ketones such as acetone, methyl ethyl ketone, and methyl isobutyl ketone, and esters such as methyl acetate and ethyl acetate. Among them, one or a mixture of two or more solvents having a favorable compatibility with other materials can be used.

In addition, a solid content when the coating material is prepared can be freely adjusted by the mixing amount of solvent, but is preferably 20 mass % or more and 40 mass % or less in the viewpoint of uniformly dispersing an electronic electroconductive substance such as carbon black to be described later. In the dispersing and mixing, a known dispersion apparatus using beads such as a sand mill, a paint shaker, a DYNO-MILL, or a pearl mill can be used. In addition, immersion coating, ring coating, spray coating, or roll coating can be used as the coating method.

As the resin layer, it is possible to use a resin layer containing the cross-linked urethane resin containing an electroconductivity imparting agent such as an electronic electroconductive substance or an ionic electroconductive substance. A volume resistivity of the surface layer is adjusted to preferably $10^3$ Ωcm or more and $10^{11}$ Ωcm or less, and more preferably $10^4$ Ωcm or more and $10^{10}$ Ωcm or less.

As the electronic electroconductive substance, an electroconductive filler to be described later can be used, but electroconductive carbon is preferable because electroconductivity is easily controlled with a small amount thereof.

Examples of the ionic electroconductive substance may include the following substances: an inorganic ion electroconductive substance such as sodium perchlorate, lithium perchlorate, calcium perchlorate, or lithium chloride; and an organic ion electroconductive substance such as modified aliphatic dimethylammonium ethosulfate or stearylammonium acetate.

These electroconductivity imparting agents are used in an amount needed to adjust the surface layer to have an appropriate volume resistivity. In general, the electroconductivity imparting agent is used in a range of 0.5 parts by mass or more and 50 parts by mass or less by mass with respect to 100 parts by mass of a binder resin.

Next, the resin layer formed as described above is impregnated with a liquid acrylic monomer. The resin layer can be impregnated with the liquid acrylic monomer used as an impregnating solution that is used as it is or adequately diluted with various solvents. By adequately diluting the liquid acrylic monomer with various solvents, a surface layer has further uniform surface compositions. As the solvent, any solvent can be freely selected as long as it is a solvent satisfying both the affinity with the resin layer and the solubility of the acrylic monomer.

Examples of the solvent may include alcohols such as methanol, ethanol, and n-propanol, ketones such as acetone, methyl ethyl ketone, and methyl isobutyl ketone, and esters such as methyl acetate and ethyl acetate. In addition, an adequate polymerization initiator can be mixed with the impregnating solution. The polymerization initiator will be described in detail. A method of impregnating the impregnating solution is not particularly limited, but immersion coating, ring coating, spray coating, or roll coating can be used.

As such, after the impregnation treatment is performed by the impregnating solution, a surface layer can be formed by polymerizing and curing the acrylic monomers. The polymerization and curing method is not particularly limited, but a known method can be used. Specifically, an example of the polymerization and curing method may include a thermosetting method or an ultraviolet ray irradiation method.

By such steps, the cross-linked acrylic resin is introduced into the network structure of the cross-linked urethane resin of the resin layer while being tangled with each other, thereby forming an IPN structure. In the present embodiment, it is preferable that the IPN structure is constituted by a cross-linked polymer, in particular, a cross-linked acrylic resin, that has a higher elastic modulus than that of the cross-linked urethane resin.

The IPN structure is formed by impregnating a cross-linked urethane resin, that is, a first component, with acrylic monomers and a polymerization initiator from the outer surface, and then forming a cross-linked acrylic resin as a second component polymer. In this case, the acrylic monomers are penetrated into the three-dimensional network structure of the cross-linked urethane resin and polymerized, thereby forming a network structure of the cross-linked acrylic resin. In order to satisfy requirements of Expressions (1) and (2), a thickness of the thus-obtained surface layer is 1.1 μm or more, and is preferably 1.4 μm or more, and more preferably 2.0 μm or more from the viewpoint of a film strength. In addition, an upper limit of the thickness of the surface layer is not particularly set, but in a case where a single layer surface is formed on a substrate on which an intermediate layer is formed, the upper limit of the thickness of the surface layer is 200.0 μm or less, preferably 160.0 μm or less, and more preferably 150.0 μm or less from the viewpoint of the flexibility. It should be noted that the thickness of the surface layer here refers to a film thickness of a portion excluding protruded portions formed by addition of the roughness particles and the like.

[Cross-Linked Urethane Resin]

The surface layer has a matrix containing a cross-linked urethane resin as a binder. The cross-linked urethane resin is suitable as a binder because it has an excellent flexibility and strength.

A urethane resin can be obtained from polyol and isocyanate, or a chain extender, if necessary.

Examples of the polyol used as a raw material for the urethane resin may include polyether polyol, polyester polyol, polycarbonate polyol, polyolefin polyol, acrylic polyol, and mixtures thereof.

Examples of the isocyanate used as a raw material for the urethane resin may include the following compounds:

tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate, and mixtures thereof. Examples of the chain extender used as a raw material for the urethane resin may include a bifunctional low molecular diol such as ethylene glycol, 1,4-butanediol, or 3-methylpentanediol, a trifunctional low molecular triol such as trimethylolpropane, and mixtures thereof. In addition, it is preferable to use a prepolymer-type isocyanate compound obtained by reacting various isocyanate compounds and various polyols described above in advance in a state in which isocyanate groups are excessive, and having the isocyanate group at a terminal thereof. In addition, as such an isocyanate compound, a material obtained by blocking an isocyanate group with various blocking agents such as MEK oxime may be used.

Even in a case where any material is used, a urethane resin can be obtained by reacting polyol and isocyanate with each other by heating. Furthermore, one or both of polyol and isocyanate have a branched structure, and the number of functional groups is 3 or more, such that the obtained urethane resin becomes a cross-linked urethane resin.

[Cross-Linked Acrylic Resin]

The cross-linked acrylic resin has a high strength, but when the cross-linked acrylic resin is used alone, the surface layer may be hard and brittle.

Accordingly, in a case where the surface layer of the electrophotographic member is used as a single layer, scratches due to scraping of the surface layer caused due to rubbing are easily generated because the surface layer has brittleness. In addition, a load to the toner is easily increased due to the hardness, which may cause filming.

On the other hand, in a case where an IPN structure is introduced in the vicinity of the extreme outer surface of the surface layer having a matrix containing a cross-linked urethane resin, the hardness and brittleness are not easily exhibited, and a high strength can be applied to the surface layer while maintaining flexibility.

The cross-linked acrylic resin is formed by polymerizing an acrylic monomer. The acrylic monomer here refers to not only an acrylic monomer but also a methacrylic monomer. That is, the cross-linked acrylic resin is formed by polymerizing any one or both of an acrylic monomer and a methacrylic monomer.

In order for the cross-linked acrylic resin to constitute an IPN structure together with the cross-linked urethane resin in the vicinity of the extreme outer surface of the surface layer, as described above, the resin layer containing the cross-linked urethane is impregnated with a liquid acrylic monomer and cured, thereby forming an IPN structure.

As the acrylic monomer used here, a polyfunctional monomer having a plurality of acryloyl groups or methacryloyl groups as a functional group is used in order to form a cross-linked structure. Meanwhile, since when the number of functional groups is 4 or more, a viscosity of the acrylic monomer is significantly increased, the acrylic monomer hardly intrudes to the surface of the resin layer formed of the cross-linked urethane resin. As a result, it is difficult to form the IPN structure. Therefore, the acrylic monomer is preferably a monomer having a total number of two or three acryloyl groups or methacryloyl groups in one molecule, and is preferably a bifunctional acrylic monomer having a total number of two acryloyl groups or methacryloyl groups in one molecule. In addition, a combination of monofunctional monomers may be used, if necessary.

A molecular weight of the acrylic monomer is preferably in a range of 200 or more and 750 or less. By using the molecular weight in the range, the formation of the IPN structure becomes easy for the network structure of the cross-linked urethane resin, such that a strength of the surface layer can be effectively increased.

As described above, the resin layer containing the cross-linked urethane resin is impregnated with the acrylic monomer. To this end, it is required for the acrylic monomer to have an appropriate viscosity. That is, the resin layer is difficult to be impregnated with the acrylic monomer at a high viscosity of the acrylic monomer, and the control of the impregnation state is difficult at a low viscosity of the acrylic monomer. Therefore, the viscosity of the acrylic monomer is preferably 5.0 mPa·s or more and 140 mPa·s or less at 25° C.

That is, the IPN structure constituted by the cross-linked urethane resin and the cross-linked acrylic resin can be formed by selecting one type or two or more types of acrylic monomers satisfying the molecular weight range and viscosity range described above, impregnating the resin layer with the acrylic monomers, and polymerizing the acrylic monomers.

The method of polymerizing the acrylic monomers is not particularly limited, but a known method can be used. Specifically, an example of the polymerization method may include a heating method or an ultraviolet ray irradiation method.

In various polymerization methods, a known radical polymerization initiator or ionic polymerization initiator can be used.

Examples of the polymerization initiator used when performing heating and polymerization may include peroxides such as 3-hydroxy-1,1-dimethylbutylperoxy neodecanoate, α-cumylperoxy neodecanoate, t-butylperoxy neoheptanoate, t-butylperoxy pivalate, t-amylperoxynormal octoate, t-butyl peroxy2-ethylhexylcarbonate, dicumyl peroxide, di-t-butyl peroxide, di-t-amyl peroxide, 1,1-di(t-butylperoxy)cyclohexane, and n-butyl-4,4-di(t-butylperoxy)valerate; and azo compounds such as 2,2-azobisbutyronitrile, 2,2-azobis(4-methoxy-2,4-dimethylvaleronitrile), 2,2-azobis(2,4-dimethylvaleronitrile), 2,2-azobis(2-methylbutyronitrile), 1,1-azobis(cyclohexane-1-carbonitrile), 2,2-azobis[2-(2-imidazoline-2-yl)propane], 2,2-azobis[2-methyl-N-(2-hydroxyethyl)propionamide], 2,2-azobis[N-(2-propenyl)-2-methylpropionamide], 2,2-azobis(N-butyl-2-methoxypropionamide), and dimethyl-2,2-azobis (isobutyrate).

Examples of the polymerization initiator used when performing irradiation with ultraviolet rays and polymerization may include 2,2-methoxy-1,2-diphenylethane-1-on, 1-hydroxycyclohexyl phenyl ketone, 2-hydroxy-2-methyl-1-phenylpropane-1-on, 1-[4-(2-hydroxyethoxy)-phenyl]-2-hydroxy-2-methyl-1-propane-1-on, 2-hydroxy-1-{4-[4-(2-hydroxy-2-methyl-propionyl)-benzil]-phenyl}-2-methylpropane-1-on, 2-methyl-1-[4-(methylthio)phenyl]-2-morpholinopropane-1-on, 2-benzyl-2-dimethylamino-1-(4-morpholinophenyl)-butane-1-on, 2-dimethylamino-2-(4-methylbenzyl)-1-(4-morpholine-4-yl-phenyl)-butane-1-on, bis(2,4,6-trimethylbenzyl)-phenylphosphine oxide, and 2,4,6-trimethylbenzoyl-diphenylphosphine oxide.

It should be noted that the polymerization initiator may be used alone and may be used in a combination of two or more thereof.

In addition, the amount of polymerization initiator is preferably 0.5 parts by mass or more and 10 parts by mass or less when the total amount of the compound (for example, a compound having a (meth)acryloyl group) for forming a specific resin is 100 parts by mass, from the viewpoint of efficiently performing a reaction.

It should be noted that a known apparatus can be appropriately used as a heating apparatus or an ultraviolet ray irradiating apparatus. As a light source radiating ultraviolet rays, an LED lamp, a high-voltage mercury lamp, a metal-halide lamp, a xenon lamp, a low-voltage mercury lamp, and the like can be used. A required cumulative light quantity during the polymerization can be appropriately adjusted depending on the type or addition amount of compound and polymerization initiator to be used.

<Measurement Method of SPM Elastic Modulus>

First, a cross section region of the electrophotographic member to be measured is cut out into a thin piece using a diamond knife in a state in which a temperature is maintained at −110° C. with a cryomicrotome (product name: EMFC6, manufactured by Leica Microsystems GmbH). In addition, a sample having a square of 100 μm and a width of 100 μm in a depth direction is prepared from the thin piece.

Figure 4:
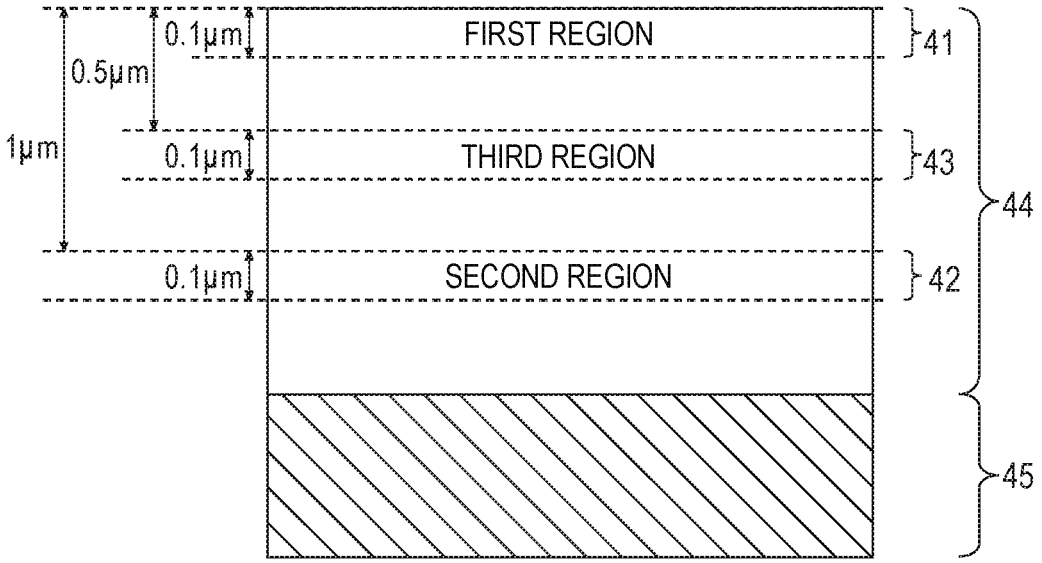
FIG. 4 is a cross-sectional view of an electrophotographic member according to an embodiment of the present disclosure.

Here, FIG. 4 illustrates a schematic cross-sectional view of a surface layer 44 formed on an electroconductive substrate 45. In the present disclosure, as illustrated in FIG. 4, a region from an outer surface of the surface layer 44 to a depth of 0.1 μm from the outer surface of the surface layer 44, a region from a depth of 1.0 μm from the outer surface of the surface layer 44 to 1.1 μm from the outer surface of the surface layer 44, and a region from a depth of 0.5 μm from the outer surface of the surface layer 44 to 0.6 μm from the outer surface of the surface layer 44 are defined as a first region in a thickness direction 41, a second region in a thickness direction 42, and a third region in a thickness direction 43, respectively. In each region appearing in the cross section of the prepared sample, an elastic modulus of a matrix containing a cross-linked urethane resin as a binder is measured. In the measurement, an SPM apparatus (product name: MFP-3D-Origin, manufactured by Oxford Instruments) and a probe (product name: AC160, manufactured by Olympus Corporation) are used. At this time, a force curve is measured 10 times and an arithmetic average of 8 points excluding the maximum value and the minimum value is obtained, thereby calculating an elastic modulus with the Hertz theory. The elastic moduli of the matrix in the first region 41, the second region 42, and the third region 43 are E1, E2, and E3, respectively.

<Observation Method of Interpenetrating Polymer Network (IPN) Structure>

In order to observe that an IPN structure is formed, a method by extracting a solvent, a method of observing a shift of a glass transition point before and after the IPN structure is formed, and the like may be used, but in the present disclosure, the observation is performed from an SPM elastic modulus and a peak top temperature of a thermochromatogram.

In a case where the IPN structure is formed, the elastic modulus is increased by entangling polymers with each other. Accordingly, the presence or absence of the IPN structure can be observed by observing a magnitude relationship of the elastic modulus in the presence or absence of the formation of the IPN structure. That is, in the present embodiment, when the elastic moduli of the outer surface and the vicinity of the outer surface (first region), the outer surface having the IPN structure constituted by the cross-linked urethane resin and the cross-linked acrylic resin, and an elastic modulus of an inner portion from the outer surface (second region and third region) are compared with each other, the former has a high elastic modulus.

In addition, by entangling the polymers with each other, a pyrolysis temperature, that is, a peak top temperature of a thermochromatogram is shifted to a high temperature side. Accordingly, the presence or absence of the IPN structure can be observed by observing a magnitude relationship of the peak top temperature of the thermochromatogram in the presence or absence of the formation of the IPN structure. That is, in the present disclosure, when a peak top of a cross-linked acrylic resin constituting an IPN structure together with a cross-linked urethane resin and a peak top of a cross-linked acrylic resin used alone are compared with each other, the former has a peak top temperature present in the high temperature side. Therefore, when, in the sample collected from the surface layer, the peak top temperatures of the thermochromatogram derived from the cross-linked acrylic resin before and after the cross-linked urethane resin is decomposed and removed are compared with each other, in a case where the peak top temperature before the cross-linked urethane resin is decomposed and removed is high, it can be observed that the IPN structure is formed.

The thermochromatogram here means a mass spectrum that can be obtained by micro-sampling mass spectrometry and is called an ion chromatogram. An outline of the micro-sampling mass spectrometry will be described below.

<Micro-Sampling Mass Spectrometry>

First, similarly to the measurement of the SPM elastic modulus, the region of the electrophotographic member to be measured is cut into a thin piece with a cryomicrotome to prepare a sample. Specifically, samples each having a square of 100 μm and a width of 0.1 μm in a depth direction is prepared from the first to third regions of the surface layer. In the measurement, for example, an ion trap-type mass spectrometry apparatus mounted on a gas chromatography mass spectrometry apparatus ("Polaris Q" (product name, manufactured by Thermo Electron Corporation)) is used. The sample is fixed to a filament disposed on an end of a probe and directly introduced into an ionization chamber. Subsequently, the sample is rapidly heated from room temperature to 1,000° C. at a constant heating rate.

The sample is decomposed by the heating, and an evaporated sample is ionized by irradiation with electron beams and detected by a mass spectrometer. At this time, under conditions of a constant heating rate, a thermochromatogram is obtained, the thermochromatogram being similar to that in a thermogravimetry-mass spectrometry (TG-MS) method and having a mass spectrum called a total ion chromatogram (TIC).

In addition, since the thermochromatogram with respect to the filament having a predetermined mass can also be obtained, the peak top temperature of the thermochromatogram that corresponds to a decomposition temperature of a predetermined polymer structure can be obtained. The peak top temperature of the thermochromatogram has a correlation with the cross-linked structure in the resin structure. As a cross-linking density is increased, the peak top temperature is shifted to the high temperature side.

In the electrophotographic member of the present embodiment, the IPN structure constituted by the cross-linked urethane resin and the cross-linked acrylic resin is formed in vicinity of the extreme outer surface of surface layer, such that the cross-linked urethane resin and the cross-linked acrylic resin are maintained close to each other even in a high temperature environment. Therefore, since an interaction of an intermolecular force between the cross-linked urethane resin and the cross-linked acrylic resin can be exhibited even in the high temperature environment, the scratches due to scraping of the surface caused due to rubbing can be suppressed even in the high temperature environment.

Since the cross-linked urethane constitutes the IPN structure together with the cross-linked acrylic resin, a cross-linking density near the cross-linked urethane resin becomes relatively high, such that the outer surface of the surface layer is more reinforced. As a result, the suppression effect of the scratches due to scraping of the surface layer is increased.

Accordingly, the electrophotographic member of the present embodiment is an electrophotographic member including an electroconductive substrate, and a surface layer having a mono-layer structure, in which the surface layer has a matrix containing a cross-linked urethane resin as a binder.

When an elastic modulus of the matrix in a first region in a thickness direction of the surface layer is defined as E1, and an elastic modulus of the matrix in a second region in a thickness direction from a depth of 1.0 μm from the outer surface of the surface layer to 1.1 μm from the outer surface of the surface layer is defined as E2, E1 and E2 satisfy the following Expressions (1) and (2), respectively. In this case, the flexibility of the surface layer can be sufficiently maintained while effectively maintaining a high strength of the outer surface of the surface layer, such that scratches due to scraping of the surface layer and filming can be further suppressed at a high level.

$$E1 \geq 200 \text{ MPa} \quad (1)$$

$$10 \text{ MPa} \leq E2 \leq 100 \text{ MPa} \quad (2)$$

In addition, when an elastic modulus of the matrix in a third region in a thickness direction from a depth of 0.5 μm from the outer surface of the surface layer to 0.6 μm from the outer surface of the surface layer is defined as E3, E3 being measured in the cross section of the surface layer, E1 and E3 preferably satisfy a relationship represented by the following Expression (3). When E1 and E3 satisfy the relationship represented by Expression (3), the flexibility of the surface layer can be sufficiently maintained while effectively maintaining a high strength of the outer surface of the surface layer, such that scratches due to scraping of the surface layer and filming can be further suppressed at a high level.

$$(E1-E3)/E3>1 \quad (3)$$

The surface layer of the present embodiment contains the cross-linked acrylic resin, such that the cross-linked acrylic resin constitutes an IPN structure together with the cross-linked urethane resin, and a strength of the outer surface of the surface layer is effectively increased. As a result, scratches due to scraping of the surface layer and filming can be further suppressed at a high level.

The fact that the cross-linked acrylic resin of the present embodiment constitutes an IPN structure together with the cross-linked urethane resin may be observed by a difference between peak top temperatures of a thermochromatogram of a filament derived from the cross-linked acrylic resin before and after the cross-linked urethane resin in the composition is decomposed and removed. That is, a peak top temperature of a thermochromatogram derived from the cross-linked acrylic resin is defined as A1 (° C.), the peak top temperature being measured from a first sample sampled from the first region described above.

In addition, a peak top temperature of a thermochromatogram derived from the cross-linked acrylic resin is defined as A2 (° C.), the peak top temperature being measured from a second sample obtained by decomposing the cross-linked urethane resin contained in the first sample. When A1 and A2 satisfy a relationship represented by the following Expression (4), a strength of the outer surface of the surface layer is effectively increased, such that scratches due to scraping of the surface layer and filming can be further suppressed at a high level, which is preferable.

$$A1>A2 \quad (4)$$

In addition, in the electrophotographic member of the present embodiment, the first region and the second region described above of the surface layer preferably satisfy a relationship represented by the following Expression (5).

$$T1>T2 \quad (5)$$

In Expression (5), T1 is a peak top temperature (° C.) of a thermochromatogram derived from the cross-linked urethane resin of the first region, and T2 is a peak top temperature (° C.) of a thermochromatogram derived from the cross-linked urethane resin contained in the second region described above. When T1 and T2 satisfy a relationship represented by the following Expression (5), a strength of the outer surface of the surface layer is further effectively increased, such that scratches due to scraping of the surface layer and filming can be further suppressed at a high level.

In addition, when T1 and T2 satisfy a relationship represented by the following Expression (6), the IPN structure is appropriately constituted by the cross-linked acrylic resin, such that a strength of the outer surface can be sufficiently maintained, which is more preferable.

$$(T1-T2)>1.0 \quad (6)$$

The present disclosure is directed to achieve the suppression of the generation of scratches due to scraping of the surface of the electrophotographic member and the suppression of the occurrence of contamination by the toner, that is, filming, when a plurality of images are formed in a high temperature environment. Therefore, the IPN structure constituted by the cross-linked acrylic resin and the like is preferably formed in the vicinity of the extreme outer surface of the surface layer. This is because such a configuration can further reduce the load to the toner. Therefore, T1, T2, and T3 preferably satisfy relationships represented by the following Expressions (7) and (8).

$$T1>T3 \quad (7)$$

$$|T1-T3|>|T3-T2| \quad (8)$$

Here, T1 and T2 mean as described above, and T3 is a peak top temperature of a thermochromatogram derived from the cross-linked urethane resin of the third region described above. When T1, T2, and T3 satisfy the relationships represented by Expressions (7) and (8), it is indicated that the IPN structure is formed in the most part of the surface layer at a depth of less than 1 μm from the surface of the surface layer. Therefore, the generation of the scratches due to scraping of the surface layer and the occurrence of the filming can be suppressed at a high level.

When the surface layer described above contains one kind or a plurality of kinds of a modified silicone compound and a modified fluorine compound, the acrylic monomer stays in the vicinity of the outer surface, such that the IPN structure can be locally formed in the vicinity of the extreme outer surface. In addition, the acrylic monomer can be suppressed from being penetrated up to the depth of the surface layer, and an adequate flexibility of the surface layer can be maintained. Therefore, the generation of the scratches due to scraping of the surface layer and the occurrence of the filming can be further suppressed at a high level.

The monomer forming the cross-linked acrylic resin is a polyfunctional monomer having a plurality of acryloyl groups or methacryloyl groups as a functional group. A total number of acryloyl groups or methacryloyl groups in one molecule is preferably 2 or 3. In this case, since the monomer effectively stays in the vicinity of the outer surface, and the IPN structure is locally formed in the extreme outer surface side, the generation of the scratches due to scraping of the surface layer and the occurrence of the filming can be suppressed at a high level.

[Filler]

In addition, the surface layer may further contain a filler in order to increase a reinforce effect of the surface layer.

Examples of an insulating filler may include the following fillers: quartz fine powder, silica particles, diatomaceous earth, zinc oxide, basic magnesium carbonate, activated calcium carbonate, magnesium silicate, aluminum silicate, titanium dioxide, talc, mica powder, aluminum sulfate, calcium sulfate, barium sulfate, glass fiber, an organic reinforcing agent, and an organic filler. A surface of the filler may be hydrophobized with an organosilicon compound, such as polydiorganosiloxane. As the insulating filler, silica particles are preferably used because the silica particles are uniformly dispersed in the surface layer. Furthermore, among silica particles, silica particles subjected to a surface treatment by hydrophobization are particularly preferably used. A content of the silica particles is preferably 0.5 mass % or more and 20 mass % or less with respect to 100 parts by mass of the resin component forming the surface layer.

In view of the reinforcement performance and electroconductivity of the surface layer, a number average primary particle size of the silica particles is preferably in a range of 10 nm or more and 120 nm or less, more preferably in a range of 15 nm or more and 80 nm or less, and particularly preferably in a range of 15 nm or more and 40 nm or less. The number average primary particle size is measured as below. The silica particles are observed with a scanning electron microscope, and 100 particles in the field of view are measured to obtain an average particle size.

Examples of an electroconductive filler may include the following fillers: a carbon-based substance such as carbon black or graphite; a metal or an alloy such as aluminum, silver, gold, a tin-lead alloy, or a copper-nickel alloy; metal oxide such as zinc oxide, titanium oxide, aluminum oxide, tin oxide, antimony oxide, indium oxide, or silver oxide; and a substance obtained by performing electroconductive metal plating on various fillers with copper, nickel or silver. As the electroconductive filler, carbon black is particularly preferably used in terms of easily controlling electroconductivity and a low price. Among them, from the viewpoint of being uniformly dispersed in the surface layer, carbon black having a relatively small primary particle size and tending to be hydrophobic is particularly preferably used. In view of the reinforcement performance and electroconductivity of the surface layer, a number average primary particle size of carbon black is preferable in a range of 20 nm or more and 60 nm or less. In surface characteristics of carbon black, a pH of the carbon black is preferably 3.0 or more and 8.0 or less. In addition, a content of the carbon black is preferably 5 mass % or more and 45 mass % or less with respect to 100 parts by mass of the resin component forming the surface layer.

[Other Components]

In addition, the surface layer can contain various additives such as a cross-linking agent, a cross-linking aid, a plasticizer, a filler, an extender, a vulcanizing agent, a vulcanizing aid, an antioxidant, an anti-aging agent, a processing aid, a dispersant, and a leveling agent in addition to the components described in a range in which the function of the surface layer is not impaired.

Figure 2:
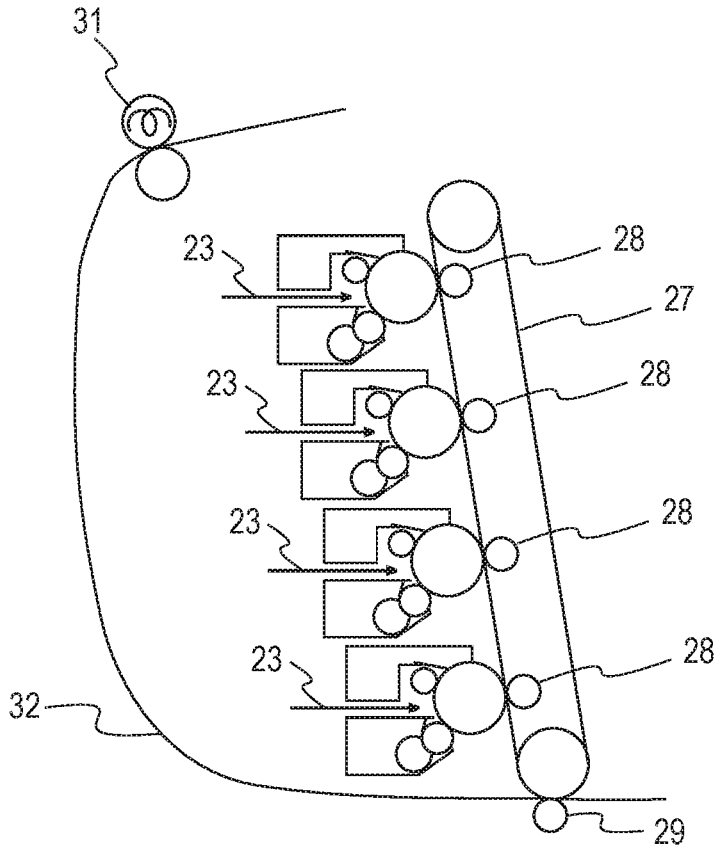
FIG. 2 is a schematic view of an electrophotographic image forming apparatus according to an embodiment of the present disclosure.

Electrophotographic Process Cartridge and Electrophotographic Image Forming Apparatus The electrophotographic image forming apparatus of the present disclosure is an apparatus including: an image carrier carrying an electrostatic latent image; a charging device primarily charging the image carrier; an exposing device forming an electrostatic latent image on the primarily charged image carrier; a developing device developing the electrostatic latent image by a toner and forming a toner image; and a transfer device transferring the toner image onto a transfer material. FIG. 2 is a schematic cross-sectional view illustrating an electrophotographic image forming apparatus according to an embodiment of the present disclosure.

Figure 3:
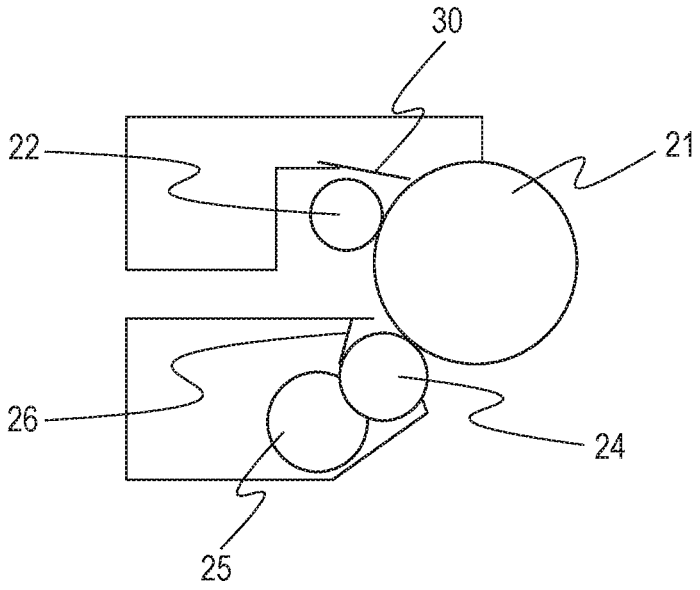
FIG. 3 is a schematic view of a process cartridge according to an embodiment of the present disclosure.

FIG. 3 is an enlarged cross-sectional view of a process cartridge mounted in the electrophotographic image forming apparatus of FIG. 2. The process cartridge includes an image carrier 21 such as a photosensitive drum, a charging device including a charging member 22, a developing device including a developing member 24, and a cleaning device including a cleaning member 30. In addition, the process cartridge is configured to be detachably attachable to a main body of the electrophotographic image forming apparatus of FIG. 2.

The image carrier 21 is uniformly charged (primarily charged) by the charging member 22 connected to a bias power source (not illustrated). At this time, a charge potential of the image carrier 21 is −800 V or higher and −400 V or lower. Next, the image carrier 21 is irradiated with exposure light 23 for forming an electrostatic latent image by an exposing device (not illustrated), and the electrostatic latent image is thus formed on the surface thereof. As the exposure light 23, either LED light or laser light can be used. A surface potential of the exposed portion of the image carrier 21 is −200 V or higher and −100 V or lower.

Next, a toner negatively charged by the developing member 24 is applied (developed) onto the electrostatic latent image, and a toner image is formed on the image carrier 21. Thus, the electrostatic latent image is converted into a visible image. At this time, a voltage of −500 V or higher and −300 V or lower is applied to the developing member 24 by a bias power source (not illustrated). It should be noted that the developing member 24 is in contact with the image carrier 21 with a nip width of 0.5 mm or more and 3 mm or less.

In the process cartridge according to an embodiment of the present disclosure, a toner-supplying roller 25 is brought into contact with the developing member 24 in a rotatable state on an upstream side of the rotation of the developing member 24 with respect to a contact portion between a developing blade 26 which is a toner regulating member and the developing member 24.

The toner image developed on the image carrier 21 is primarily transferred on an intermediate transfer belt 27. A primary transfer member 28 is in contact with a back surface of the intermediate transfer belt 27. By applying a voltage of +100 V or higher and +1,500 V or lower to the primary transfer member 28, primary transfer of the negatively charged toner image is carried out from the image carrier 21 to the intermediate transfer belt 27. The primary transfer member 28 may be a roller-shape or a blade-shape.

In a case where the electrophotographic image forming apparatus is a full-color image forming apparatus, the charging, exposure, development, and primary transfer steps described above are performed with respect to individual colors of yellow, cyan, magenta, and black. To this end, in the electrophotographic image forming apparatus illustrated in FIG. 2, four process cartridges storing toners of the individual colors are mounted to the main body of the electrophotographic image forming apparatus in a detachably attachable manner. The charging, exposure, development, and primary transfer steps described above are sequentially performed at predetermined time intervals. In such a manner, 4-color toner images for displaying a full color image are superposed on the intermediate transfer belt 27.

The toner images on the intermediate transfer belt 27 are transferred to a position facing a secondary transfer member 29 by rotation of the intermediate transfer belt 27. A recording paper is conveyed between the intermediate transfer belt 27 and the secondary transfer member 29 at a predetermined timing along a recording paper conveying route 32. By applying a secondary transfer bias voltage to the secondary transfer member 29, the toner images on the intermediate transfer belt 27 are transferred onto the recording paper. At this time, the bias voltage to be applied to the secondary transfer member 29 is +1,000 V or higher and +4,000 V or lower. The recording paper onto which the toner images are transferred by the secondary transfer member 29 is conveyed to a fixing device 31. The toner images on the recording paper are fused and fixed on the recording paper, and then the recording paper is discharged out of the electrophotographic image forming apparatus, thereby finishing the printing operation.

The toner remaining on the image carrier 21, which is not transferred from the image carrier 21 onto the intermediate transfer belt 27 is scraped off by a cleaning member 30 for cleaning the surface of the image carrier 21, thereby cleaning the surface of the image carrier 21.

According to an aspect of the present disclosure, the electrophotographic member having an extremely high durability can be provided. Further, according to another aspect of the present disclosure, the process cartridge that contributes to stably forming a high quality electrophotographic image can be obtained. Further, according to still another aspect of the present disclosure, the electrophotographic image forming apparatus capable of stably forming a high quality electrophotographic image can be obtained.

EXAMPLES

Hereinafter, various embodiments of the present disclosure will be described in detail by way of specific Examples as an example of the developing roller. The technical range of the present disclosure implemented as an electrophotographic member is not limited by these specific embodiments.

Example 1

[1. Preparation of Electroconductive Substrate]

A primer (product name: DY35-051, manufactured by Dow Corning Toray Co., Ltd.) was applied onto a core metal having an outer diameter of 6 mm and a length of 270 mm, and made of SUS304, and heating was performed at a temperature of 150° C. for 20 minutes. The core metal was placed in a cylindrical mold having an inner diameter of 12.0 mm so as to concentric with the mold.

As a material of an intermediate layer, an addition-type silicone rubber composition obtained by mixing materials shown in Table 1 with a kneader (product name: Trimix TX-15, manufactured by INOUE MFG., INC.) was heated at a temperature of 115° C. and injected into a mold. After the injection of the materials, the composition was heated and molded at a temperature of 120° C. for 10 minutes, cooled to room temperature, and then taken out from the mold, thereby obtaining an electroconductive substrate (elastic roller) in which an intermediate layer having a thickness of 3.0 mm was formed on an outer circumference of the core metal.

TABLE 1

| Material | Parts by mass |
|---|---|
| Liquid dimethyl polysiloxane having two or more alkenyl groups bonded to silicon atoms in one molecule (Product name: SF3000E, viscosity of 10,000 cP, vinyl group equivalent of 0.05 mmol/g, manufactured by KCC) | 100 |
| Platinum-based catalyst (Product name: SIP6832.2, manufactured by Gelest, Inc.) | 0.048 |
| Dimethyl polysiloxane having two or more hydrogen atoms bonded to silicon atoms in one molecule (Product name: SP6000P, Si—H group equivalent of 15.5 mmol/g, manufactured by KCC) | 0.5 |
| Carbon black (Product name: TOKABLACK #7360SB, manufactured by TOKAI CARBON CO., LTD.) | 6 |

[Formation of Surface Layer]

In the formation of a surface layer, first, a resin layer was formed. As materials of the resin layer, materials shown in Table 2 excluding a roughness-imparting particle were stirred and mixed. Subsequently, the mixture was dissolved in methyl ethyl ketone (manufactured by Kishida Chemical Co., Ltd.) and mixed so that a solid content concentration was 30 mass %, and then the mixed solution was uniformly dispersed with a sand mill. A material shown in the roughness-imparting particle column of Table 2 was added to the resultant solution obtained by adding methyl ethyl ketone to the mixed solution to adjust a solid content concentration to 25 mass %, and stirred and dispersed with a ball mill, thereby obtaining a coating material 1 for a resin layer. The elastic roller was immersed in the coating material to be coated with the coating material so that a thickness of the resin layer was about 15 μm. Subsequently, the elastic roller was heated at a temperature of 135° C. for 60 minutes, and the coated layer was dried and cured, thereby forming a resin layer.

TABLE 2

| Material | Parts by mass |
|---|---|
| Polyether polyol (Product name: PTGL1000, manufactured by Hodogaya Chemical Co., Ltd.) | 100 |
| Polymeric MDI (Product name: MR-400, manufactured by TOSOH CORPORATION) | 36.0 |
| Carbon black (Product name: SUNBLACK X15, manufactured by ASAHI CARBON CO., LTD.) | 29.3 |
| Polyether monol (Product name: Newpol 50HB-100, manufactured by SANYO CHEMICAL, LTD.) | 3.0 |
| Modified silicone oil (Product name: TSF4445, manufactured by Momentive Performance Materials Japan LLC) | 0.6 |
| Roughness-imparting particle (Product name: DAIMIC BEAZ UCN-5090, manufactured by Dainichiseika Color & Chemicals Mfg. Co., Ltd.) | 17.6 |

Subsequently, impregnation and curing treatments of an acrylic monomer were performed by the following method. As materials for an impregnating solution for an impregnation treatment, materials shown in Table 3 were dissolved and mixed. The elastic roller on which the resin layer is formed was subjected to an immersion treatment in the impregnating solution for 2 seconds, thereby impregnating elastic roller with an acrylic monomer component. Subsequently, air-drying was performed at room temperature for 30 minutes, and drying was performed at 90° C. for 1 hour, thereby volatilizing a solvent. The elastic roller subjected to the drying was irradiated with ultraviolet rays while being rotated so that a cumulative light quantity was 15,000 mJ/cm$^2$, thereby curing the acrylic monomer. As a result, a surface layer was formed. It should be noted that a high-voltage mercury lamp (product name: Handy-type UV curing apparatus, manufactured by Marionette, Inc.) was used as an ultraviolet ray irradiating apparatus.

TABLE 3

| Material | Parts by mass |
|---|---|
| Bifunctional acrylic monomer (Product name: EBECRYL145, manufactured by DAICEL-ALLNEX LTD.) | 5 |
| Photopolymerization initiator (Product name: IRGACURE184, manufactured by BASF SE) | 0.25 |
| Solvent (Product name: Methyl ethyl ketone, manufactured by Kishida Chemical Co., Ltd.) | 100 |

The obtained developing roller was evaluated as follows.

[Evaluation Method]

<Measurement of SPM Elastic Modulus>

The elastic moduli E1 to E3 of the first region to the third region were obtained by the measurement method of the SPM elastic modulus described above. Furthermore, a value of (E1−E3)/E3 was obtained by substituting the obtained elastic moduli E1 and E3 into the left side of the following Expression (3). The results are shown in Table 7.

$$(E1-E3)/E3>1 \quad (3)$$

<Measurement of T1, T2, T3, A1, and A2>

Thermochromatograms of samples sampled from the first region to the third region described above were obtained by the micro-sampling mass spectrometry described above. The peak top temperatures T1, T2, and T3 of the thermochromatograms derived from the cross-linked urethane resins in the first region, the second region, and the third region were obtained from the obtained thermochromatograms. In addition, a peak top temperature A1 of a thermochromatogram derived from the cross-linked acrylic resin from the first sample of the first region, and a peak top temperature A2 of the thermochromatogram derived from the cross-linked acrylic resin were obtained, the peak top temperature A2 being measured from the second sample obtained by decomposing the cross-linked urethane resin contained in the first sample.

It should be noted that surfaces of the roller in the second and third regions were polished and removed at a predetermined depth with a rubber roll mirror finishing machine (product name: SZC, manufactured by MINAKUCHI MACHINERY WORKS LTD.), and newly appearing surfaces were similarly cut into a thin piece by a microtome. In addition, samples (a third sample and a fourth sample) for micro-sampling mass analysis were collected from the thin piece. In addition, A2 is a value obtained by performing the micro-sampling mass spectrometry on the second sample, the second sample being obtained by decomposing the cross-linked urethane by a pyridine decomposition method to be described later. Each value is a value obtained by arithmetically averaging the respective peak top temperatures obtained by 5 measurements. The results are shown in Table 7.

<Pyridine Decomposition Method>

A pyridine decomposition method is a method of selectively decomposing a urethane bond. By performing the pyridine decomposition on a sample having an IPN structure constituted by the cross-linked acrylic resin and the cross-linked urethane resin, the cross-linked acrylic resin from which a structure derived from the cross-linked urethane resin is removed can be obtained, such that a change in peak top temperature of the thermochromatogram can be grasped by the presence or absence of the IPN structure. Specifically, the pyridine decomposition method is performed by the following method.

The sample was cut out from the surface of the developing roller at a thickness of 0.1 μm with a microtome, thereby collecting 500 mg of the sample. To the obtained sample, 0.5 mL of a mixed solution in which pyridine (manufactured by Wako Pure Chemical Industries, Ltd.) and water were mixed at a ratio of 3:1 was decomposed by performing heating at 130° C. for 15 hours in a stainless steel jacketed hermetic container ("TEFLON" (registered trademark)) formed of a fluororesin. The pyridine was removed by performing a reduced pressure treatment on the obtained decomposition product. A value of A2 was obtained by performing the micro-sampling mass spectrometry described above by using the thus-obtained sample.

<Evaluation of Durability>

(Evaluation of Scratch)

A developing roller 1 was mounted in a process cartridge for a color laser printer (product name: HP Color LaserJet Enterprise M652dn, manufactured by Hewlett-Packard Company), the process cartridge was mounted in the color laser printer, and then a state of scratches due to scraping of the surface of the developing roller and a state of filming were evaluated. The evaluation results are shown in Table 7. It should be noted that a cyan process cartridge (product name: HP 656X High Yield Cyan Original LaserJet Toner Cartridge, manufactured by Hewlett-Packard Company) for the color laser printer was used in the evaluation. The evaluation procedure is as follows.

The cyan process cartridge was left in a high-temperature and high-humidity (a temperature of 30° C. and a relative humidity of 95%) for 16 hours, and then an image with a low print rate of 0.2% was continuously output onto a recording paper to evaluate printing of a large number of sheets in the similar environment. However, since the toner was consumed by the printing, a toner was replenished whenever 50,000 sheets were output so that a toner weight in the process cartridge became 100 g. After 200,000 sheets are printed, the developing roller 1 was removed from the process cartridge, the surface of the roller was air-blown to remove the toner coated on the surface, and a state of the surface of the roller was observed, thereby carrying out the evaluations according to the following criteria.

Evaluation Criteria

Rank A: The scratches due to scraping of the surface were not observed.

Rank B: The scratches were observed, but a length of the largest scratch was less than 1 mm.

Rank C: The generation of the scratches of 1 mm or more was observed.

(Filming)

In addition, the surface of the roller was observed with a laser microscope (product name: VK-8700, manufactured by Keyence Corporation) using an objective lens with 20× magnification, thereby carrying out the evaluations of a state of the filming according to the following criteria.

Evaluation Criteria

Rank A: The area of the fixed toner to the total surface area of the roller was 5% or less.

Rank B: The area of the fixed toner to the total surface area of the roller was more than 5% and 15% or less. Rank C: The area of the fixed toner to the total surface area of the roller was more than 15%.

Examples 2 to 10 and 13 to 15

Coating materials for resin layers were prepared by using materials shown in Table 4, impregnating solutions were prepared by using materials shown in Table 5, and developing rollers were prepared by a combination of the coating material and the impregnating solution as shown in Table 6, by the same methods as those of Example 1. The obtained developing rollers were evaluated by the same method as that of Example 1. The evaluation results are shown in Table 7.

Example 11

By setting a solid content concentration before the roughness-imparting particles of the coating material for a resin layer were mixed to 20 mass %, a thickness of a resin layer was changed to 5 μm. In addition, a coating material for a resin layer was prepared by using materials shown in Table 4, an impregnating solution was prepared by using materials shown in Table 5, and a developing roller was prepared by a combination of the coating material and the impregnating solution as shown in Table 6, by the same methods as those of Example 1. The obtained developing roller was evaluated by the same method as that of Example 1. The evaluation results are shown in Table 7.

Example 12

By setting a solid content concentration before the roughness-imparting particles of the coating material for a resin layer are mixed to 32 mass %, a thickness of a resin layer was changed to 30 μm. In addition, a coating material for a resin layer was prepared by using materials shown in Table 4, an impregnating solution was prepared by using materials shown in Table 5, and a developing roller was prepared by a combination of the coating material and the impregnating solution as shown in Table 6, by the same methods as those of Example 1. The obtained developing roller was evaluated by the same method as that of Example 1. The evaluation results are shown in Table 7.

Comparative Examples 1 to 4 and 6

Coating materials for resin layers were prepared by using materials shown in Table 4, impregnating solutions were prepared by using materials shown in Table 5, and developing rollers were prepared by a combination of the coating material and the impregnating solution as shown in Table 6, by the same methods as those of Example 1. The obtained developing rollers were evaluated by the same method as that of Example 1. The evaluation results are shown in Table 7.

Comparative Example 5

A synthetic solution containing a photopolymerizable polymer A described in Example of Japanese Patent Application Laid-Open No. 2014-197064 was obtained. Specifically, to a 100 mL reaction flask, 1.66 g (0.36 mmol) of acrylate-modified silicone oil (manufactured by Shin-Etsu Chemical Co., Ltd., "X-22-174DX"), 5.61 g (13 mmol) of 2-(perfluorohexyl)ethyl acrylate (manufactured by Daikin Industries, Ltd., "R-1620"), 1.69 g (13 mmol) of 2-hydroxyethyl methacrylate (manufactured by Tokyo Chemical Industry Co., Ltd.), 7.37 g (73.64 mmol) of methyl methacrylate (manufactured by Junsei Chemical Co., Ltd.), 1.24 g (4 mmol) of dimethyl 1,1'-azobis(1-cyclohexanecarboxylate) (manufactured by FUJIFILM Wako Pure Chemical Corporation, "VE-73"), and 75 g of methyl ethyl ketone (MEK) were charged, and bubbled with nitrogen while being stirred for 5 minutes, and then polymerization was performed at an internal liquid temperature of 75° C. for 7 hours, thereby producing a copolymer. Subsequently, to the reaction flask, 2.02 g (13 mmol) of 2-isocyanatoethyl methacrylate (manufactured by SHOWA DENKO K.K., "KarenzMOI") and 0.001 g of bismuth tris(2-ethylhexanoate) (manufactured by FUJIFILM Wako Pure Chemical Corporation) were added, the mixture was stirred at an internal liquid temperature of 75° C. for 10 hours to react the hydroxyl group in the polymerization unit derived from 2-hydroxyethyl methacrylate in the copolymer with the isocyanate group in the 2-isocyanatoethyl methacrylate, thereby obtaining a solution containing a photopolymerizable polymer A. A coating material for a resin layer was prepared by using materials shown in Table 4, an impregnating solution was prepared by using materials shown in Table 5, and a developing roller was prepared by a combination of the coating material and the impregnating solution as shown in Table 6, by the same methods as those of Example 1 except that the photopolymerizable polymer A was used as a material for an impregnating solution. The obtained developing roller was evaluated by the same method as that of Example 1. The evaluation results are shown in Table 7.

Comparative Example 7

A coating material for a resin layer was prepared by using materials shown in Table 4 and a developing roller was prepared by the same methods as those of Example 1 except that impregnation and curing treatments of an acrylic monomer were not performed. The obtained developing roller was evaluated by the same method as that of Example 1. The evaluation results are shown in Table 7.

Comparative Example 8

A coating material for a resin layer was prepared by using materials shown in Table 4 by using a surface modifier A described in Example of Japanese Patent Application Laid-Open No. 2017-049282 as a material of a coating material for a resin layer, and a developing roller was prepared by a combination of the coating material and the impregnating solution as shown in Table 6. The obtained developing roller was evaluated by the same method as that of Example 1. The evaluation results are shown in Table 7.

TABLE 4

| | | Coating material for resin layer No. | | | | | | | | | | | | | |
|---|---|---|---|---|---|---|---|---|---|---|---|---|---|---|---|
| Classification | Material name | 1 | 2 | 3 | 4 | 5 | 6 | 7 | 8 | 9 | 10 | 11 | 12 | 13 | 14 |
| Polyol | PTGL1000 | 100 | 100 | — | 100 | — | 100 | 100 | 100 | — | 100 | 100 | 100 | 100 | 100 |
| | PTGL3500 | — | — | 100 | — | 100 | — | — | — | — | — | — | — | — | — |

TABLE 4-continued

| Classification | Material name | Coating material for resin layer No. | | | | | | | | | | | | | |
|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 |
| Isocyanate | MR-400 | 36.0 | 36.0 | 6.3 | 36.0 | 3.6 | 36.0 | 36.0 | 36.0 | — | 36.0 | 36.0 | 36.0 | 36.0 | 36.0 |
| Themoplastic urethane resin | ME-8115LP | — | — | — | — | — | — | — | — | 100 | — | — | — | — | — |
| Carbon black | SUNBLACK X15 | 29.3 | 29.3 | 26.3 | 29.3 | 26.1 | 29.3 | 29.3 | 29.3 | 29.3 | 29.3 | 29.3 | 29.3 | 29.3 | 29.3 |
| Silica | MSP-013 | — | — | — | — | — | — | — | — | — | — | — | — | — | 5.9 |
| Monool component | 50HB-100 | 3.0 | 3.0 | 3.0 | 3.0 | 3.0 | 3.0 | 3.0 | 3.0 | 3.0 | 3.0 | 3.0 | 3.0 | 3.0 | 3.0 |
| Modified silicone compound | TSF4445 | 0.6 | 1.2 | 1.1 | — | — | 1.2 | 1.2 | 3.6 | — | — | — | 1.2 | 1.2 | 1.2 |
| Modified fluorine compound | MEGAFUC F430 | — | — | — | — | — | — | — | — | — | 1.2 | — | — | — | — |
| Copolymer derived from acrylate | Surface modifier A | — | — | — | — | — | — | — | — | — | — | 3.6 | — | — | — |
| Roughness-imparting particle | UCN-5090 | 17.6 | 17.6 | 15.8 | 17.6 | 15.7 | — | — | 17.6 | 17.6 | 17.6 | 17.6 | — | — | — |
| | UCN-5070 | — | — | — | — | — | 17.6 | — | — | — | — | — | — | | |
| | UCN-5150 | — | — | — | — | — | — | 17.6 | — | — | — | — | — | — | — |
| | C-200 | — | — | — | — | — | — | — | — | — | — | — | 17.6 | — | — |
| | C-1000 | — | — | — | — | — | — | — | — | — | — | — | — | 17.6 | — |
| | CE-300TH | — | — | — | — | — | — | — | — | — | — | — | — | — | 17.6 |

* The numbers in the tables represent contents of the respective materials in parts by mass.

* The materials listed in the tables are as follows.

"PTGL1000": product name, polyol, manufactured by Hodogaya Chemical Co., Ltd.

"PTGL3500": product name, polyol, manufactured by Hodogaya Chemical Co., Ltd.

"MR-400" ("Millionate MR-400", product name, isocyanate compound, manufactured by TOSOH CORPORATION) (polymeric MDI))

"ME-8115LP" ("Resamine ME-8115LP"): product name, thermoplastic urethane resin, manufactured by Dainichiseika Color & Chemicals Mfg. Co., Ltd.

"SUNBLACK X15": product name, carbon black, manufactured by ASAHI CARBON CO., LTD. (Volatile content: 2.1%)

"MSP-013": product name, silica subjected to hydrophobic treatment, manufactured by TAYCA CORPORATION "50HB-100" (Newpol 50HB-100): product name, monol(poly(oxyethyleneoxypropylene)glycol monobutyl ether, manufactured by SANYO CHEMICAL, LTD., molecular weight: Mn = 510

"TSF4445": product name, modified silicone compound, manufactured by Momentive Performance Materials Japan LLC "MEGAFUC F430": product name, modified fluorine compound, manufactured by DIC Corporation Surface modifier A: surface modifier A disclosed in Example of Japanese Patent Application Laid-Open No. 2017-049282

UCN-5090: product name "DAIMIC BEAZ UCN-5090", cross-linked urethane resin particle, manufactured by Dainichiseika Color & Chemicals Mfg. Co., Ltd., average particle size of 9 μm UCN-5070: product name "DAIMIC BEAZ UCN-5070", cross-linked urethane resin particle, manufactured by Dainichiseika Color & Chemicals Mfg. Co., Ltd., average particle size of 7 μm UCN-5150: product name "DAIMIC BEAZ UCN-5150", cross-linked urethane resin particle, manufactured by Dainichiseika Color & Chemicals Mfg. Co., Ltd., average particle size of 15 μm C-200: product name "Art Pearl C-200 transparent", cross-linked urethane resin particle, manufactured by Negami Chemical Industrial Co., Ltd., average particle size of 32 μm C-1000: product name "Art Pearl C-1000 transparent", cross-linked urethane resin particle, manufactured by Negami Chemical Industrial Co., Ltd., average particle size of 3 μm CE-300TH: ("Art Pearl CE-300TH"): product name, cross-linked urethane resin particle, manufactured by Negami Chemical Industrial Co., Ltd., average particle size of 23 μm

TABLE 5

| Classification | Material name | Impregnating solution No. | | | | | |
|---|---|---|---|---|---|---|---|
| | | 1 | 2 | 3 | 4 | 5 | 6 |
| Acrylic monomer | EBECRYL 145 | 5 | — | — | — | — | — |
| | TMPTA | — | 1 | — | — | — | — |
| | EBECRYL 11 | — | — | 5 | — | — | — |
| | Pentaerythritol triacrylate | — | — | — | 23.8 | — | — |
| | NK ester 9G | — | — | — | — | 5 | — |
| | NK ester 14G | — | — | — | — | — | 5 |
| Acrylic polymer | Photopolymerizable polymer A solution (20 mass % solution) | — | — | — | 1.19 | — | — |
| Initiator | IRGACURE184 | 0.25 | 0.25 | 0.25 | 1.19 | 0.25 | 0.25 |
| Solvent | Methyl ethyl ketone | 100 | 100 | 100 | 100 | 100 | 100 |

* The numbers in the tables represent contents of the respective materials in parts by mass.

* The materials listed in the tables are as follows.

EBECRYL145: bifunctional acrylic monomer, manufactured by DAICEL-ALLNEX LTD.

TMPTA: trifunctional acrylic monomer, manufactured by DAICEL-ALLNEX LTD.

EBECRYL11: bifunctional acrylic monomer, manufactured by DAICEL-ALLNEX LTD.

Pentaerythritol triacrylate: trifunctional acrylic monomer, manufactured by Shin-Nakamura Chemical Co., Ltd.

NK ester 9G: bifunctional acrylic monomer, manufactured by Shin-Nakamura Chemical Co., Ltd.

NK ester 14G: bifunctional acrylic monomer, manufactured by Shin-Nakamura Chemical Co., Ltd.

Photopolymerizable composition A solution (solution of 20 mass %): photopolymerizable acrylic monomer described in Example of Japanese Patent Application Laid-Open No. 2014-197064

IRGACURE184: photopolymerization initiator, manufactured by BASF SE

TABLE 6

| | Resin layer | Impregnation treatment |
|---|---|---|
| Example 1 | Coating material for resin layer 1 | Impregnating solution 1 |
| Example 2 | Coating material for resin layer 2 | Impregnating solution 1 |
| Example 3 | Coating material for resin layer 3 | Impregnating solution 2 |
| Example 4 | Coating material for resin layer 2 | Impregnating solution 2 |
| Example 5 | Coating material for resin layer 8 | Impregnating solution 1 |
| Example 6 | Coating material for resin layer 1 | Impregnating solution 5 |
| Example 7 | Coating material for resin layer 1 | Impregnating solution 6 |
| Example 8 | Coating material for resin layer 10 | Impregnating solution 1 |
| Example 9 | Coating material for resin layer 6 | Impregnating solution 1 |
| Example 10 | Coating material for resin layer 7 | Impregnating solution 1 |
| Example 11 | Coating material for resin layer 1 | Impregnating solution 1 |
| Example 12 | Coating material for resin layer 1 | Impregnating solution 1 |

TABLE 6-continued

| | Resin layer | Impregnation treatment |
|---|---|---|
| Example 13 | Coating material for resin layer 12 | Impregnating solution 1 |
| Example 14 | Coating material for resin layer 13 | Impregnating solution 1 |
| Example 15 | Coating material for resin layer 14 | Impregnating solution 1 |
| Comparative Example 1 | Coating material for resin layer 4 | Impregnating solution 1 |
| Comparative Example 2 | Coating material for resin layer 4 | Impregnating solution 3 |
| Comparative Example 3 | Coating material for resin layer 4 | Impregnating solution 2 |
| Comparative Example 4 | Coating material for resin layer 5 | Impregnating solution 3 |
| Comparative Example 5 | Coating material for resin layer 4 | Impregnating solution 4 |
| Comparative Example 6 | Coating material for resin layer 9 | Impregnating solution 1 |
| Comparative Example 7 | Coating material for resin layer 1 | — |
| Comparative Example 8 | Coating material for resin layer 11 | — |

TABLE 7

| List | E1 (Mpa) | E3 (Mpa) | E2 (Mpa) | (E1-E3) (Mpa) | A1 | A2 | T1 | T3 | T2 | T1-T2 | T1-T3 | T3-T2 | Thickness (μm) | Scratch | Filming |
|---|---|---|---|---|---|---|---|---|---|---|---|---|---|---|---|
| Example 1 | 350 | 100 | 40 | 2.50 | 395.0 | 392.0 | 382.3 | 378.6 | 378.3 | 4.0 | 3.7 | 0.3 | 15 | A | A |
| Example 2 | 370 | 80 | 25 | 3.63 | 395.0 | 392.0 | 382.6 | 378.5 | 378.2 | 4.4 | 4.1 | 0.3 | 15 | A | A |
| Example 3 | 210 | 50 | 10 | 3.20 | 394.0 | 391.0 | 382.2 | 378.4 | 377.8 | 4.4 | 3.8 | 0.6 | 15 | B | A |
| Example 4 | 1100 | 340 | 100 | 2.24 | 397.0 | 394.0 | 386.5 | 382.4 | 378.6 | 7.9 | 4.1 | 3.8 | 15 | A | B |
| Example 5 | 400 | 70 | 25 | 4.71 | 395.3 | 392.3 | 382.7 | 378.5 | 378.2 | 4.5 | 4.2 | 0.3 | 15 | A | B |
| Example 6 | 220 | 65 | 37 | 2.38 | 393.9 | 390.9 | 382.2 | 378.5 | 378.2 | 4.0 | 3.7 | 0.3 | 15 | A | A |
| Example 7 | 200 | 55 | 30 | 2.64 | 393.7 | 390.9 | 382.1 | 378.4 | 378.2 | 3.9 | 3.7 | 0.2 | 15 | B | A |
| Example 8 | 370 | 80 | 25 | 3.63 | 395.0 | 392.0 | 382.6 | 378.5 | 378.2 | 4.4 | 4.1 | 0.3 | 15 | A | A |
| Example 9 | 370 | 80 | 25 | 3.63 | 395.0 | 392.0 | 382.6 | 378.5 | 378.2 | 4.4 | 4.1 | 0.3 | 15 | A | A |
| Example 10 | 370 | 80 | 25 | 3.63 | 395.0 | 392.0 | 382.6 | 378.5 | 378.2 | 4.4 | 4.1 | 0.3 | 15 | A | A |
| Example 11 | 350 | 100 | 40 | 2.50 | 395.0 | 392.0 | 382.3 | 378.6 | 378.3 | 4.0 | 3.7 | 0.3 | 5 | A | A |
| Example 12 | 350 | 100 | 40 | 2.50 | 395.0 | 392.0 | 382.3 | 378.6 | 378.3 | 4.0 | 3.7 | 0.3 | 30 | A | A |
| Example 13 | 370 | 80 | 25 | 3.63 | 395.0 | 392.0 | 382.6 | 378.5 | 378.2 | 4.4 | 4.1 | 0.3 | 15 | A | A |
| Example 14 | 370 | 80 | 25 | 3.63 | 395.0 | 392.0 | 382.6 | 378.5 | 378.2 | 4.4 | 4.1 | 0.3 | 15 | A | A |
| Example 15 | 372 | 82 | 27 | 3.54 | 395.0 | 392.0 | 382.6 | 378.5 | 378.2 | 4.4 | 4.1 | 0.3 | 15 | A | B |
| Comparative Example 1 | 320 | 250 | 150 | 0.28 | 394.9 | 391.9 | 382.3 | 380.0 | 379.1 | 3.2 | 2.3 | 0.9 | 15 | A | C |
| Comparative Example 2 | 70 | 55 | 35 | 0.27 | 392.5 | 389.5 | 378.5 | 378.4 | 378.2 | 0.3 | 0.1 | 0.2 | 15 | C | A |
| Comparative Example 3 | 1050 | 910 | 380 | 0.15 | 397.0 | 394.0 | 386.5 | 384.0 | 382.5 | 4.0 | 2.5 | 1.5 | 15 | A | C |
| Comparative Example 4 | 20 | 12 | 9 | 0.67 | 392.0 | 389.0 | 378.0 | 377.8 | 377.6 | 0.4 | 0.2 | 0.2 | 15 | C | A |
| Comparative Example 5 | 4500 | 4500 | 4500 | 0.00 | 395.0 | 395.0 | — | — | 390.0 | — | — | — | 15 | C | C |
| Comparative Example 6 | 25 | 25 | 25 | 0.00 | 393.0 | 393.0 | 366.0 | 366.0 | 366.0 | 0.0 | 0.0 | 0.0 | 15 | C | C |
| Comparative Example 7 | 20 | 20 | 20 | 0.00 | — | — | 378.0 | 378.0 | 378.0 | 0.0 | 0.0 | 0.0 | 15 | C | A |
| Comparative Example 8 | 20 | 20 | 20 | 0.00 | — | — | 378.0 | 378.0 | 378.0 | 0.0 | 0.0 | 0.0 | 15 | C | A |

* It is considered that, in Comparative Example 5, the first region and the third region were mainly constituted by the cross-linked acrylic resin, from the fact that the peak top temperatures T1 and T3 of the thermochromatogram derived from the cross-linked urethane resin were not obtained.

[Consideration of Evaluation Result]

In each of the electrophotographic members of Examples 1 to 15, the elastic moduli E1 and E2 of the surface layer simultaneously satisfied Expressions (1) and (2) defined in the present disclosure. As a result, even in the evaluation of the durability by printing of a large number of sheets in a high temperature environment, the generation of the scratches due to scraping of the surface layer and the filming were suppressed.

In Comparative Examples 1 and 3, the elastic modulus E1 satisfied Expression (1), but the elastic modulus E2 did not satisfy Expression (2), thus the filming was deteriorated. In Comparative Example 5, since the surface layer was entirely too hard, both the scratches and the filming were deteriorated. In Comparative Examples 2, 4, 7, and 8, the elastic modulus E1 did not satisfy Expression (1), thus the scratches were deteriorated. In Comparative Example 6, the matrix of the surface layer contains the thermoplastic urethane resin as a binder rather than a cross-linked urethane resin, thus an IPN structure was not formed. As a result, both the scratches and the filming were deteriorated.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-069102, filed Mar. 29, 2019, and Japanese Patent Application No. 2019-187337, filed Oct. 11, 2019, which are hereby incorporated by reference herein in their entirety.

What is claimed is:

1. An electrophotographic member, comprising:

an electroconductive substrate; and a surface layer formed on the substrate, said surface layer being a single layer and having a matrix containing a cross-linked urethane resin as a binder, wherein $$E1 \geq 200 \text{ MPa and } 10 \text{ MPa} \leq E2 \leq 100 \text{ MPa}$$

when E1 is an elastic modulus of the matrix in a first region in a thickness direction from an outer surface of the surface layer to a depth of 0.1 μm from the outer surface of the surface layer, and E2 is an elastic modulus of the matrix in a second region in a thickness direction from a depth of 1.0 to 1.1 μm from the outer surface of the surface layer, E1 and E2 being measured in a cross section of the surface layer in a thickness direction.

2. The electrophotographic member according to claim 1, wherein (E1−E3)/E3>1 when E3 is an elastic modulus of the matrix in a third region from a depth of 0.5 to 0.6 μm from the outer surface of the surface layer is defined as E3, E3 being measured in the cross section of the surface layer in a thickness direction.

3. The electrophotographic member according to claim 1, wherein the surface layer contains a cross-linked acrylic resin, and the cross-linked acrylic resin constitutes an interpenetrating polymer network structure together with the cross-linked urethane resin.

4. The electrophotographic member according to claim 3, wherein a monomer forming the cross-linked acrylic resin is a polyfunctional monomer having acryloyl groups or methacryloyl groups as a functional group, and a total number of acryloyl groups or methacryloyl groups included in one molecule is 2 or 3.

5. The electrophotographic member according to claim 3, wherein A1>A2 when A1 (° C.) is a peak top temperature of a thermochromatogram derived from the cross-linked acrylic resin, A1 being measured from a first sample sampled from the first region, and A2 (° C.) is a peak top temperature of a thermochromatogram derived from the cross-linked acrylic resin, A2 being measured from a second sample obtained by decomposing the cross-linked urethane resin contained in the first sample.

6. The electrophotographic member according to claim 1, wherein T1>T2 when T1 (° C.) is a peak top temperature of a thermochromatogram derived from the cross-linked urethane resin, T1 being measured from a first sample sampled from the first region, and T2 (° C.) is a peak top temperature of a thermochromatogram derived from the cross-linked urethane resin, T2 being measured from a third sample sampled from the second region.

7. The electrophotographic member according to claim 6, wherein (T1−T2)>1.0.

8. The electrophotographic member according to claim 6, wherein T1>T3 and |T1−T3|>|T3−T2| when T3 (° C.) is a peak top temperature of a thermochromatogram derived from the cross-linked urethane resin, T3 being measured from a fourth sample in the cross section of the surface layer in a thickness direction, the fourth sample being sampled from a third region from a depth of 0.5 to 0.6 μm from the outer surface of the surface layer.

9. The electrophotographic member according to claim 1, wherein the surface layer further comprises at least one kind of a modified silicone compound or a modified fluorine compound.

10. An electrophotographic process cartridge detachably attachable to a main body of an electrophotographic apparatus, the electrophotographic process cartridge comprising an electrophotographic member, the electrophotographic member including:

an electroconductive substrate; and a surface layer formed on the substrate, said surface layer being a single layer and having a matrix containing a cross-linked urethane resin as a binder, wherein $$E1 \geq 200 \text{ MPa and } 10 \text{ MPa} \leq E2 \leq 100 \text{ MPa}$$

when E1 is an elastic modulus of the matrix in a first region in a thickness direction from an outer surface of the surface layer to a depth of 0.1 μm from the outer surface of the surface layer, and E2 is an elastic modulus of the matrix in a second region in a thickness direction from a depth of 1.0 to 1.1 μm from the outer surface of the surface layer, E1 and E2 being measured in a cross section of the surface layer in a thickness direction.

11. The electrophotographic process cartridge according to claim 10, wherein the electrophotographic member is included as a developing member.

12. An electrophotographic image forming apparatus comprising: an image carrier carrying an electrostatic latent image; a charging device primarily charging the image carrier; an exposing device forming an electrostatic latent image on the primarily charged image carrier; a developing member developing the electrostatic latent image by a toner and forming a toner image; and a transfer device transferring the toner image onto a transfer material, the developing member being an electrophotographic member, the developing member including:

an electroconductive substrate; and a surface layer formed on the substrate, said surface layer being a single layer and having a matrix containing a cross-linked urethane resin as a binder, wherein $$E1 \geq 200 \text{ MPa and } 10 \text{ MPa} \leq E2 \leq 100 \text{ MPa}$$

when E1 is an elastic modulus of the matrix in a first region in a thickness direction from an outer surface of the surface layer to a depth of 0.1 μm from the outer surface of the surface layer, and E2 is an elastic modulus of the matrix in a second region in a thickness direction from a depth of 1.0 to 1.1 μm from the outer surface of the surface layer, E1 and E2 being measured in a cross section of the surface layer in a thickness direction.

* * * * *